US009679469B2

(12) United States Patent
Lin et al.

(10) Patent No.: US 9,679,469 B2
(45) Date of Patent: Jun. 13, 2017

(54) REMOTE CONTROL CIRCUIT

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventors: Ching-Chung Lin, New Taipei (TW); Fu-Shan Cui, Shenzhen (CN)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 496 days.

(21) Appl. No.: 14/452,966

(22) Filed: Aug. 6, 2014

(65) Prior Publication Data

US 2015/0042179 A1 Feb. 12, 2015

(30) Foreign Application Priority Data

Aug. 8, 2013 (CN) ..... 2013 1 0343310

(51) Int. Cl.
*G08C 17/00* (2006.01)

(52) U.S. Cl.
CPC ..... *G08C 17/00* (2013.01); *Y10T 307/944* (2015.04)

(58) Field of Classification Search
CPC ..... H02M 2001/0032; H02M 3/33523; H02M 3/33507; H02M 1/36; Y02B 70/16; H02J 9/005
USPC ..... 307/31, 66, 112–119, 140, 142–144; 363/16, 21.01, 97
See application file for complete search history.

(56) References Cited

U.S. PATENT DOCUMENTS

2010/0165669 A1* 7/2010 Li ..... H02M 1/34 363/21.04
2014/0268938 A1* 9/2014 Matthews ..... H02M 1/32 363/50
2014/0268951 A1* 9/2014 Wang ..... H02M 7/12 363/78

* cited by examiner

*Primary Examiner* — Thienvu Tran
*Assistant Examiner* — David M Stables
(74) *Attorney, Agent, or Firm* — Steven Reiss

(57) ABSTRACT

A remote control circuit includes a rectifying filter circuit coupled to an alternating current (AC) power source, a power supply module connected to the rectifying filter circuit; a leakage energy collecting circuit connected to the rectifying filter circuit; a remote control signal receiving circuit connected to the leakage energy collecting circuit; and a switch circuit connected to the remote control signal receiving circuit and the power supply module. When the remote control signal receiving circuit receives a remote power on signal, the remote control signal receiving circuit outputs a first signal to the switch circuit, and the switch circuit switches on the power supply module. When the remote control signal receiving circuit receives a remote power off signal, the remote control signal receiving circuit outputs a second signal to the switch circuit, the switch circuit switches off the power supply module.

20 Claims, 5 Drawing Sheets

REMOTE CONTROL CIRCUIT

CROSS-REFERENCE TO RELATED APPLICATIONS

This application claims priority to China Patent Application No. 201310343310.9 filed on Aug. 8, 2013 in the State Intellectual Property Office of China, the contents of which are incorporated by reference herein.

FIELD

The present disclosure relates to a remote control circuit of an electronic device.

BACKGROUND

A remote control unit can be used to turn on or off an electronic device such as a television or a monitor. When the electronic device is in a standby mode, the electronic device still consumes a small amount of electricity.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
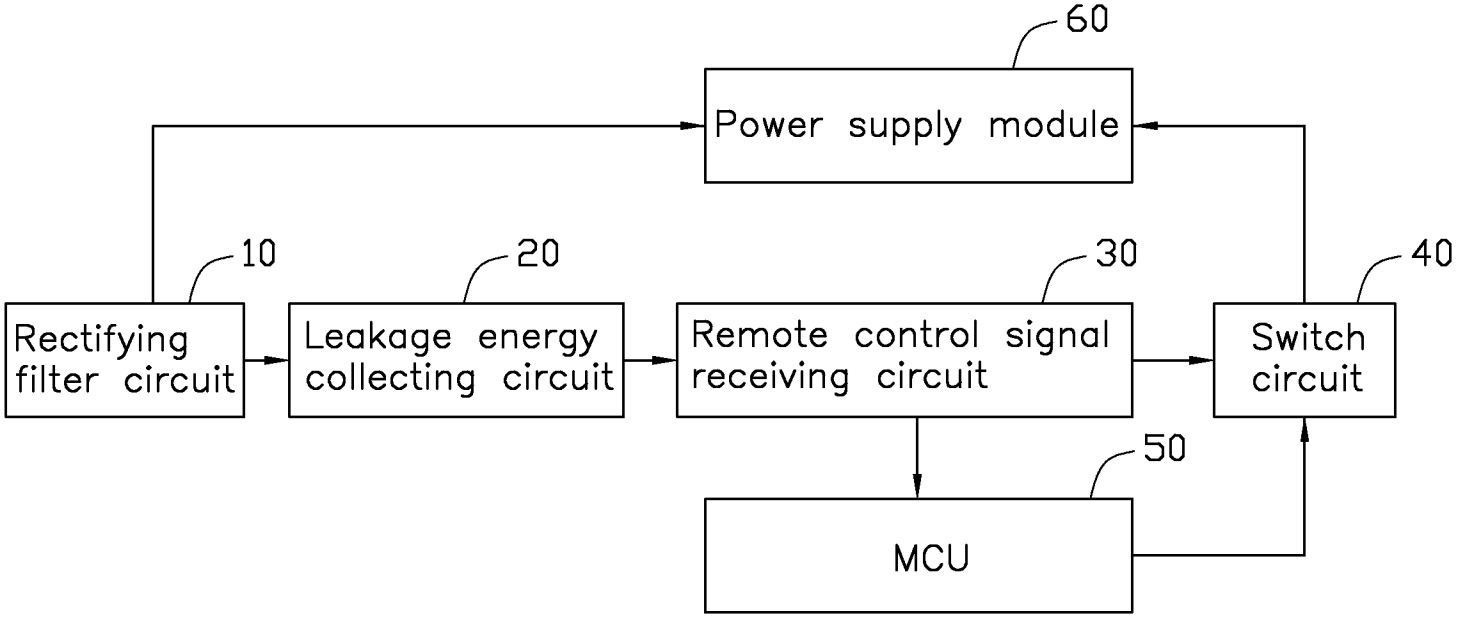
FIG. 1 is a block diagram of an embodiment of a remote control circuit.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Figure 2:
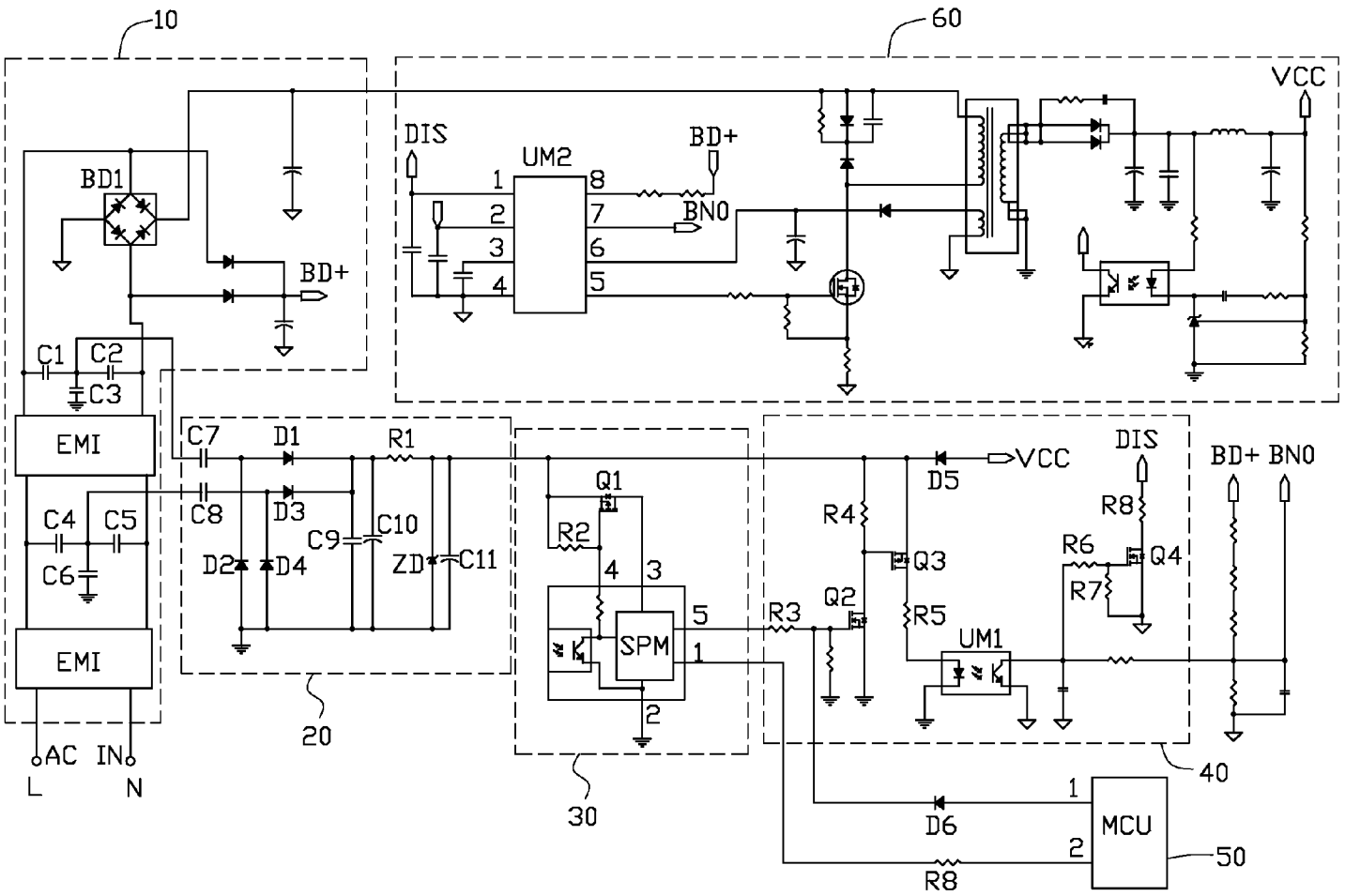
FIG. 2 is a circuit diagram of the remote control circuit of FIG. 1, the remote control circuit including a leakage energy collecting circuit, a remote control signal receiving circuit, and a switch circuit.

FIGS. 1 and 2 illustrate a remote control circuit of an electronic device, such as a monitor, an all-in-one computer, or a television. The remote control circuit includes a rectifying filter circuit 10, a leakage energy collecting circuit 20 connected to the rectifying filter circuit 10, a remote control signal receiving circuit 30 connected to the leakage energy collecting circuit 20, a switch circuit 40 connected to the remote control signal receiving circuit 30, a Micro Control Unit (MCU) 50 connected to the remote control signal receiving circuit 30 and the switch circuit 40, and a power supply module 60 connected to the switch circuit 40.

FIG. 2 illustrates the rectifying filter circuit 10 includes Y safety capacitors C1-C3 and C4-C6, and a bridge rectifier circuit BD1. The rectifying filter circuit 10 includes a first input terminal L and a second input terminal N. The first input terminal L can be connected to a live wire of a 220V AC power source. The second input terminal N can be connected to a null wire of the 220V AC power source.

Figure 3:
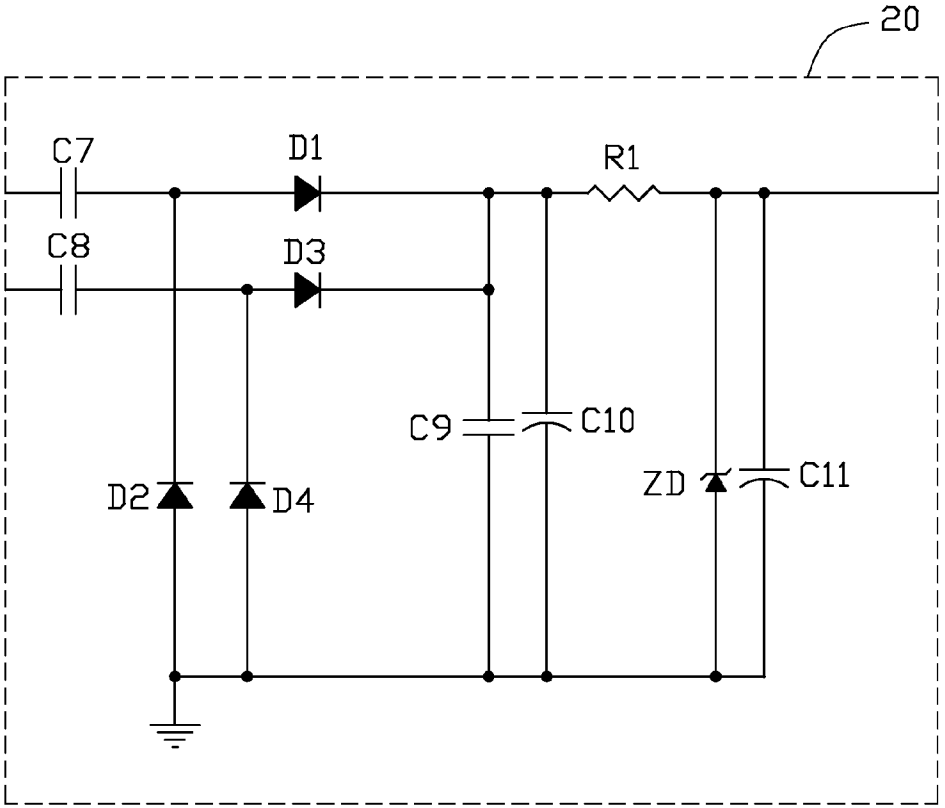
FIG. 3 illustrates a circuit diagram of the leakage energy collecting circuit of FIG. 2.

FIGS. 2 and 3 illustrate the leakage energy collecting circuit 20 includes a first leakage energy collecting unit and a second leakage energy collecting unit. The first leakage energy collecting unit includes a capacitor C7, and diodes D1-D2. The leakage energy collecting circuit includes a capacitor C8, and diodes D3-D4. Capacitors C9 and C10 are configured to store leakage energy of the safety capacitors C1-C3 and C4-C6. The leakage energy collecting circuit 20 further includes a resistor R1, a Zener diode ZD, and a capacitor C11. The leakage energy collecting circuit 20 can provide a power source VCC (see FIG. 2) to the remote control signal receiving circuit 30. A working principle of the leakage energy collecting circuit 20 is detailed as follows. The 220V AC power source supplied to the rectifying filter circuit 10 is a sine wave. When a positive half wave is supplied to the capacitor C8, electric power is fed to the capacitors C9 and C10 via the diode D3 for charging the capacitors C9 and C10. When a negative half wave is supplied to the capacitor C8, electric power is fed to the capacitors C9 and C10 via the diode D4 for charging the capacitors C9 and C10. The capacitor C11 can be charged by electric power store by the capacitors C9 and C10 and provide the power source VCC to the remote control signal receiving circuit 30. The capacitor C11 can be replaced by another energy storing component, such as a chargeable battery.

Figure 4:
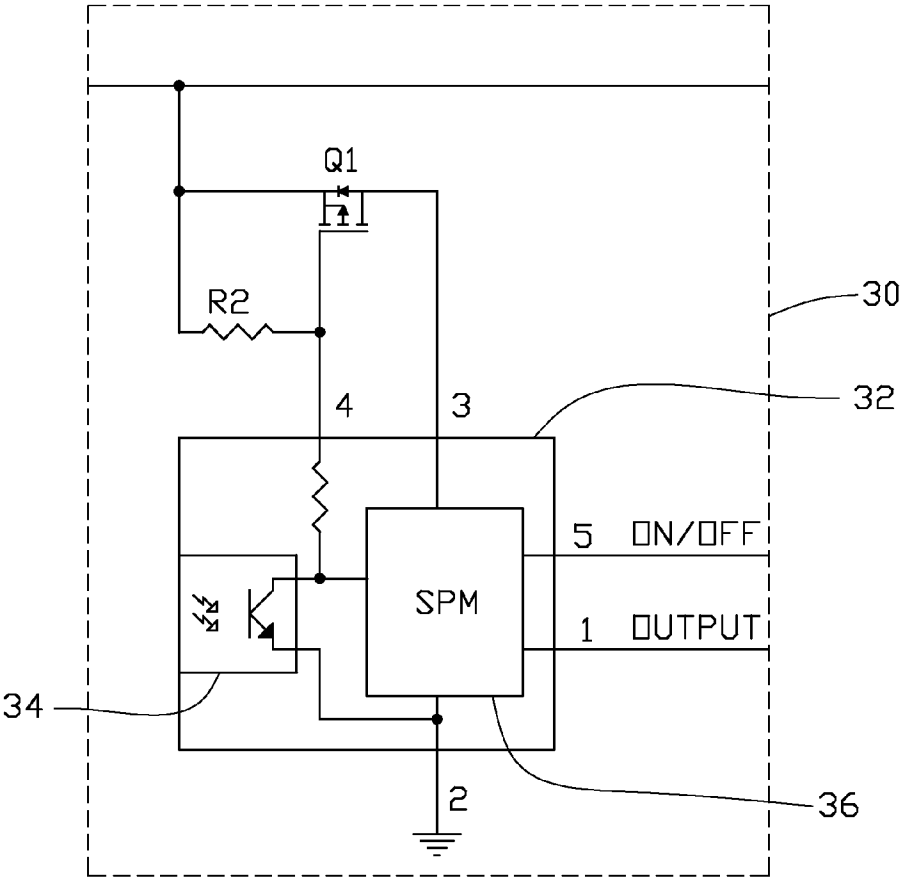
FIG. 4 illustrates a circuit diagram of the remote control signal receiving of FIG. 2.

FIGS. 2 and 4 illustrate the remote control signal receiving circuit 30 includes a remote control signal receiving module 32 and a transistor Q1 connected to the remote control signal receiving module 32. The remote control signal receiving module 32 includes a photoelectric receiver 34 and a signal processing module (SPM) 36. The remote control signal receiving module 32 includes five terminals 1-5. The photoelectric receiver 34 can receive remote control signals. A first output terminal of the photoelectric receiver 34 is connected to the terminal 4 of the remote control signal receiving module 32 via a resistor. A second output terminal of the photoelectric receiver 34 is connected to the terminal 2 of the remote control signal receiving module 32 which is grounded. The signal processing module 36 is connected to the first output terminal of the photoelectric receiver 34. Two output terminals are connected to the terminals 1 and 5. The terminal 1 can output an on/off signal to switch the switch circuit 40 on or off. The terminal 5 can provide an OUTPUT signal to inform the MCU 50 whether the remote control signal receiving circuit 30 receives a power on signal. A gate terminal of the transistor Q1 is connected to the terminal 4 and connected to the output terminal of the leakage energy collecting circuit 20 via a resistor R2. A source terminal of the transistor Q1 is directly connected to the leakage energy collecting circuit 20. A drain terminal of the transistor Q1 is connected to the terminal 3. The transistor Q1 can be a P channel MOSFET.

When the photoelectric receiver 34 receives a power on signal from a remote control unit, the phototransistor of the photoelectric receiver 34 is switched on. The terminal 4 is grounded. The transistor Q1 is switched on. The terminal 5 of the remote control signal receiving module 32 outputs a high level signal (for example, 5V) to the switch circuit 40. The switch circuit 40 switches on the power supply module 60. The terminal 1 of the remote control signal receiving module 32 outputs a signal to the MCU 50 to inform the MCU 50 that the photoelectric receiver 34 has received the power on signal. The MCU 50 outputs a high level signal to a gate terminal of the transistor Q2 to switch on the transistor Q2. When the photoelectric receiver 34 receives a power off signal, the terminal 5 of the remote control signal receiving module 32 outputs a low level signal to the switch circuit 40. The switch circuit 40 switches off the power supply module 60, thereby avoiding unnecessary power consumption.

Figure 5:
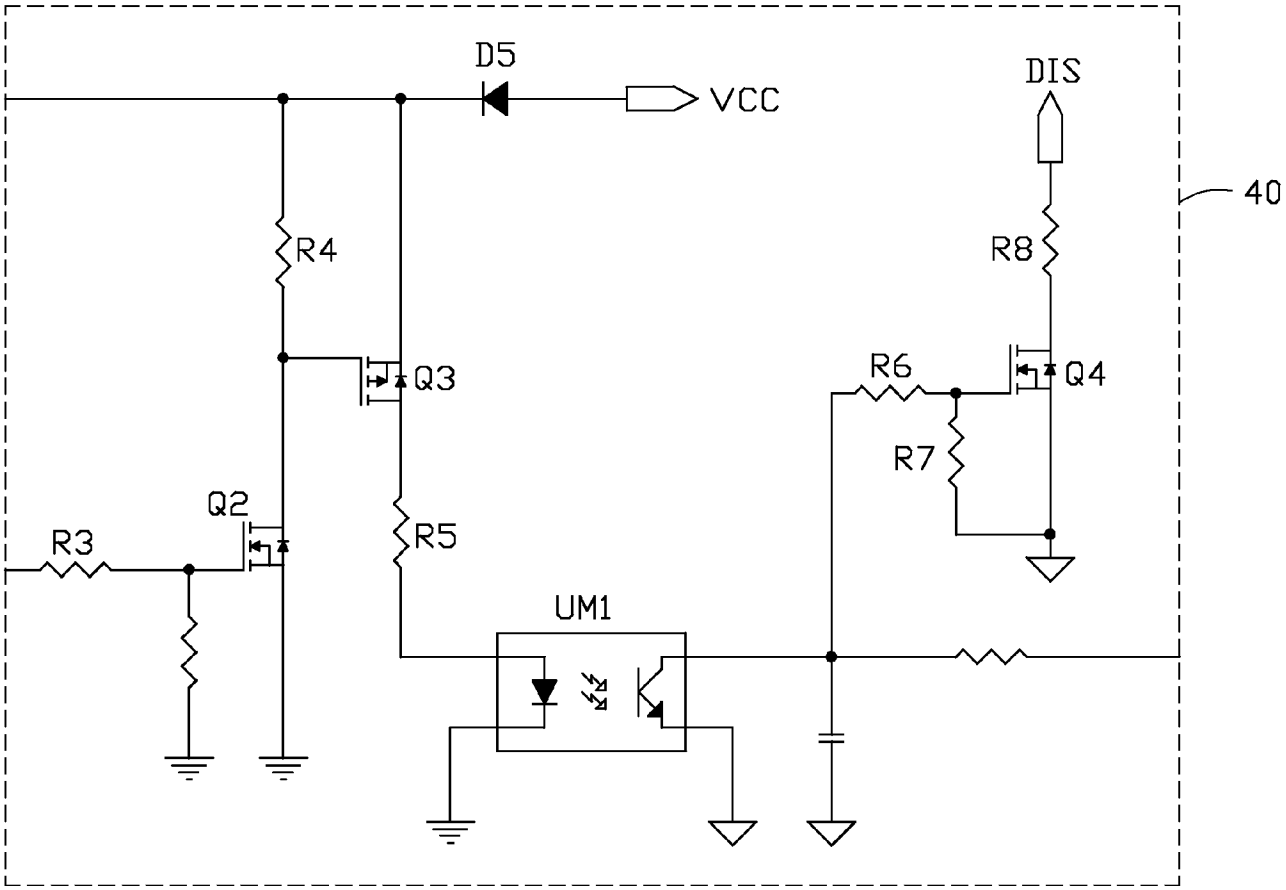
FIG. 5 illustrates a circuit diagram of the switch circuit of FIG. 2.

FIGS. 2 and 5 illustrate the switch circuit 40 including transistors Q2-Q4 and an optical coupler UM1. The gate terminal of the transistor Q2 is connected to the terminal 5 of the remote control signal receiving module 32 via a resistor R3. A drain terminal of the transistor Q2 is coupled to the power source VCC via a resistor R4 and a diode D5. A source terminal of the transistor Q2 is grounded. A gate terminal of the transistor Q3 is connected to the drain terminal of the transistor Q2. A drain terminal of the transistor Q3 is connected to the optical coupler UM1 via a resistor R5. A source terminal of the transistor Q3 is connected to the power source VCC via the diode D5. A first output terminal of the optical coupler UM1 is connected to a gate terminal of the transistor Q4 via a resistor R6. A second output terminal of the optical coupler UM1 is grounded. A resistor R7 is connected between the gate terminal and the source terminal of the transistor Q4. A drain terminal of the transistor Q4 can provide a DIS signal to the power supply module 60. A source terminal of the transistor Q4 is grounded. In one embodiment, the transistors Q4 and Q2 can be N channel MOSFETS. The transistor Q3 can be a P channel MOSFET. Pin 1 of the MCU 50 is connected to the gate terminal of the transistor Q2 via a diode D6. Pin 2 of the MCU 50 is connected to the terminal 1 of the remote control signal receiving circuit 30 via a resistor R8.

When the remote control signal receiving circuit 30 receives the power on signal, the terminal 5 of the remote control signal receiving circuit 30 outputs the high level signal to the switch circuit 40. The transistors Q2 and Q3 are switched on. The LED of the optical coupler UM1 is powered on. The phototransistor of the optical coupler UM1 is switched on. Two output terminals of the optical coupler UM1 are grounded. The transistor Q4 is switched off. Pin 1 of a control chip UM2 of the power supply module 60 is idle. The power supply module 60 is powered on.

When the remote control signal receiving circuit 30 receives the power off signal, the terminal 5 of the remote control signal receiving circuit 30 outputs the low level signal to the switch circuit 40. The transistors Q2 and Q3 are switched off. The LED of the optical coupler UM1 is powered off. The phototransistor of the optical coupler UM1 is switched off. The transistor Q4 is switched on. Pin 1 of the control chip UM2 is connected to ground via the resistor R8 and the transistor Q4. The power supply module 60 is powered off when the pin 1 of UM2 is at low level.

The embodiments shown and described above are only examples. Many details are often found in the art such as the other features of an electronic device with remote control function. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A remote control circuit comprising:

a rectifying filter circuit, coupled to an alternating current (AC) power source, and comprising safety capacitors;

a power supply module connected to the rectifying filter circuit;

a leakage energy collecting circuit, connected to the rectifying filter circuit, and capable of being charged by the safety capacitors;

a remote control signal receiving circuit connected to the leakage energy collecting circuit; and a switch circuit connected to the remote control signal receiving circuit and the power supply module;

wherein when the remote control signal receiving circuit receives a remote power on signal, the remote control signal receiving circuit outputs a first signal to the switch circuit, and the switch circuit switches on the power supply module; and when the remote control signal receiving circuit receives a remote power off signal, the remote control signal receiving circuit outputs a second signal to the switch circuit, the switch circuit switches off the power supply module.

2. The remote control circuit of claim 1, wherein the remote control signal receiving circuit comprises a photoelectric receiver and a signal processing module connected to the photoelectric receiver; when photoelectric receiver receives the remote power on signal, the signal processing module outputs the first signal to the switch circuit; when the photoelectric receiver receives the remote power off signal, the signal processing module outputs the second signal to the switch circuit.

3. The remote control circuit of claim 2, wherein the remote control signal receiving circuit further comprises a first transistor, a gate terminal of the first transistor is connected to the photoelectric receiver, a source terminal of the first transistor is connected to an output terminal of the leakage energy collecting circuit, and a drain terminal of the first transistor is connected to the signal processing module.

4. The remote control circuit of claim 3, further comprising a MCU connected to the signal processing module, wherein the signal processing module comprises first output terminal connected to the switch circuit and a second output terminal connected to the MCU; the first output terminal of the signal processing module is configured to output the first signal or the second signal to the switch circuit; the second output terminal of the signal processing module is configured to output a signal to inform the MCU whether the remote control signal receiving circuit receives the remote power on signal.

5. The remote control circuit of claim 4, wherein the first signal is at high level, and the second signal is at low level; when the remote control signal receiving circuit receives the remote power on signal, the MCU outputs a high level signal to the switch circuit.

6. The remote control circuit of claim 5, wherein the switch circuit comprises a second transistor, a third transistor, a fourth transistor, and an optical coupler; a gate terminal of the second transistor is connected to the first output terminal of the signal processing module; when the first output terminal of the signal processing module outputs the first signal, the second transistor, the third transistor and the optical coupler are switched on, and the fourth transistor is switched off; when the first output terminal of the signal processing module outputs the second signal, the second transistor, the third transistor and the optical coupler are switched off, and the fourth transistor is switched on.

7. The remote control circuit of claim 6, wherein a drain terminal of the second transistor and a gate terminal of the third transistor is connected to a power source; a source terminal of the second transistor is grounded, a drain terminal of the third transistor is connected to an input terminal of the optical coupler; a source terminal of the third transistor is connected to the power source; one output terminal of the optical coupler is connected to the gate terminal of the fourth transistor, the other output terminal of the optical coupler is grounded; a drain terminal of the fourth transistor is connected to the power supply module, and a source terminal of the fourth transistor is grounded.

8. The remote control circuit of claim 7, wherein when the remote control signal receiving circuit receives the remote power on signal, the fourth transistor is switched off, and the switch circuit controls the power supply module to be powered on; when the remote control signal receiving circuit receives the remote power off signal, the fourth transistor is switched on, and the switch circuit controls the power supply module to be powered off.

9. The remote control circuit of claim 8, wherein the first transistor and the third transistor are P-channel MOSFETS; and the second transistor and the fourth transistor are N-channel MOSFETS.

10. The remote control circuit of claim 1, wherein the leakage energy collecting circuit comprises a capacitor, a first diode, a second diode, and an energy storing component, one terminal of the capacitor is connected to the safety capacitors; the other terminal of the capacitor is connected to a positive terminal of the first diode, a negative terminal of the first diode is connected to a positive terminal of the energy storing component; a negative terminal of the second diode is connected to the positive terminal of the first diode; a positive terminal of the second diode and a negative terminal of the energy storing component are grounded.

11. A remote control circuit comprising:

a rectifying filter circuit coupled to an alternating current (AC) power source;

a power supply module connected to the rectifying filter circuit;

a leakage energy collecting circuit, connected to the rectifying filter circuit, and comprising an energy storing component capable of being charged by the rectifying filter circuit;

a remote control signal receiving circuit connected to the leakage energy collecting circuit; and a switch circuit connected to the remote control signal receiving circuit and the power supply module;

wherein when the remote control signal receiving circuit receives a remote power on signal, the remote control signal receiving circuit outputs a first signal to the switch circuit, and the switch circuit switches on the power supply module; and when the remote control signal receiving circuit receives a remote power off signal, the remote control signal receiving circuit outputs a second signal to the switch circuit, the switch circuit switches off the power supply module.

12. The remote control circuit of claim 11, wherein the remote control signal receiving circuit comprises a photoelectric receiver and a signal processing module connected to the photoelectric receiver; when photoelectric receiver receives the remote power on signal, the signal processing module outputs the first signal to the switch circuit; when the photoelectric receiver receives the remote power off signal, the signal processing module outputs the second signal to the switch circuit.

13. The remote control circuit of claim 12, wherein the remote control signal receiving circuit further comprises a first transistor, a gate terminal of the first transistor is connected to the photoelectric receiver, a source terminal of the first transistor is connected to an output terminal of the leakage energy collecting circuit, and a drain terminal of the first transistor is connected to the signal processing module.

14. The remote control circuit of claim 13, further comprising a MCU connected to the signal processing module, wherein the signal processing module comprises first output terminal connected to the switch circuit and a second output terminal connected to the MCU; the first output terminal of the signal processing module is configured to output the first signal or the second signal to the switch circuit; the second output terminal of the signal processing module is configured to output a signal to inform the MCU whether the remote control signal receiving circuit receives the remote power on signal.

15. The remote control circuit of claim 14, wherein the first signal is at high level, and the second signal is at low level; when the remote control signal receiving circuit receives the remote power on signal, the MCU outputs a high level signal to the switch circuit.

16. The remote control circuit of claim 15, wherein the switch circuit comprises a second transistor, a third transistor, a fourth transistor, and an optical coupler; a gate terminal of the second transistor is connected to the first output terminal of the signal processing module; when the first output terminal of the signal processing module outputs the first signal, the second transistor, the third transistor and the optical coupler are switched on, and the fourth transistor is switched off; when the first output terminal of the signal processing module outputs the second signal, the second transistor, the third transistor and the optical coupler are switched off, and the fourth transistor is switched on.

17. The remote control circuit of claim 16, wherein a drain terminal of the second transistor and a gate terminal of the third transistor is connected to a power source; a source terminal of the second transistor is grounded, a drain terminal of the third transistor is connected to an input terminal of the optical coupler; a source terminal of the third transistor is connected to the power source; one output terminal of the optical coupler is connected to the gate terminal of the fourth transistor, the other output terminal of the optical coupler is grounded; a drain terminal of the fourth transistor is connected to the power supply module, and a source terminal of the fourth transistor is grounded.

18. The remote control circuit of claim 17, wherein when the remote control signal receiving circuit receives the remote power on signal, the fourth transistor is switched off, and the switch circuit controls the power supply module to be powered on; when the remote control signal receiving circuit receives the remote power off signal, the fourth transistor is switched on, and the switch circuit controls the power supply module to be powered off.

19. The remote control circuit of claim 18, wherein the first transistor and the third transistor are P-channel MOSFETS; and the second transistor and the fourth transistor are N-channel MOSFETS.

20. The remote control circuit of claim 11, wherein the rectifying filter circuit comprises safety capacitors; the leakage energy collecting circuit comprises a capacitor, a first diode, and a second diode, one terminal of the capacitor is connected to the safety capacitors; the other terminal of the capacitor is connected to a positive terminal of the first diode, a negative terminal of the first diode is connected to a positive terminal of the energy storing component; a negative terminal of the second diode is connected to the positive terminal of the first diode; a positive terminal of the second diode and a negative terminal of the energy storing component are grounded.

* * * * *